United States Patent [19]

Johnson

[11] 4,428,137

[45] Jan. 31, 1984

[54] CARTRIDGE MAGAZINE

[76] Inventor: James H. Johnson, 818 S. Willow Ave., Tampa, Fla. 33606

[21] Appl. No.: 311,089

[22] Filed: Oct. 13, 1981

[51] Int. Cl.[3] ..... F41C 25/02
[52] U.S. Cl. ..... 42/50
[58] Field of Search ..... 42/50

[56] References Cited

U.S. PATENT DOCUMENTS

| | | | |
|---|---|---|---|
| 2,217,848 | 10/1940 | Schillstrom | 42/50 |
| 2,503,116 | 4/1950 | Maillard | 42/50 |
| 2,903,809 | 9/1959 | Stoner | 42/50 |
| 3,226,869 | 1/1966 | Musgrave | 42/50 |
| 3,345,770 | 10/1967 | Scanlon, Jr. | 42/50 |

FOREIGN PATENT DOCUMENTS

| | | | |
|---|---|---|---|
| 495229 | 4/1930 | Fed. Rep. of Germany | 42/50 |

*Primary Examiner*—Charles T. Jordan
*Attorney, Agent, or Firm*—Stefan Stein

[57] ABSTRACT

A box magazine for use in conjunction with a semiautomatic or an automatic firearm comprising a storage zone (S) for storing cartridges in a three column array, a compression zone (C) for compressing the three column array into a two column array, and a feed zone (F) for storing the two column array in a two-position feed arrangement enabling the ramming mechanism of the firearm to sequentially ram successive cartridges to the firing chamber of the firearm. The magazine comprises a spring loaded follower having an integral design for pushing the array of cartridges upward within the magazine.

14 Claims, 20 Drawing Figures

CARTRIDGE MAGAZINE

BACKGROUND OF THE INVENTION

This invention relates to a cartridge magazine for a firearm. More particularly, this invention relates to a cartridge magazine wherein several columns of cartridges are moved to feed stations by a spring loaded follower.

Presently there exist many types and styles of cartridge magazines which are designed to store cartridges therein and sequentially move the cartridges to a feeding position enabling a ramming mechanism to slide (ram) the cartridge from the feed position into the firing chamber of the firearm. The earliest types of box magazines typically comprised a single column of cartridges positioned within an elongated magazine. A spring loaded device, hereinafter referred to as a follower, is provided to exert pressure upward against the bottom of the column. A pair of feed lips retain the column of cartridges within the magazine, with the uppermost cartridge in contact with the feed lips being in the feed position. This type of feeding arrangement is referred to as "single position feeding".

In order to increase the capacity of the single column magazine, it obviously becomes necessary to increase the length thereof. This results in an excessively long magazine. Moreover, the increased length of the magazine necessarily requires a longer follower spring which renders it difficult to load the cartridges in the magazine in that the tension of the follower spring has to be overcome, the difficulty of which progressively increases as more cartridges are loaded into the magazine.

Magazines having two columns of cartridges therein have been developed which increase the ease in which the cartridges are loaded therein. It was found that the two columns of cartridges could be nested together and fed to the feed lips of the magazne, without the necessity of compressing the cartridge array into a single column prior to feeding. Moreover, a two-position feed arrangement allows the gunner to load the magazine by simply positioning the cartridge above the feed lips and pushing inwardly. For these reasons, magazines designed to store cartridges in a two column array and to feed those cartridges in a two-position arrangement are widely used in the industry.

In another effort to increase the capacity of the magazine and/or reduce the length thereof, multiple column magazines, most commonly four columns, were developed. One such four column magazine is known as the Schillstrom design, which is disclosed in U.S. Pat. No. 2,217,848. The Schillstrom magazine includes a central wall which divides the magazine into two compartments, with each compartment sized to receive two rows of cartridges. A follower and a follower spring are positioned in each of the compartments to force the respective two columns upwardly in the magazine. The four columns of cartridges merged to a single column as they approached the single position feed lips.

In other four column magazines, the need for a dividing central wall was eliminated by designing the follower to be collapsible such that the follower could enter into the compression zone of the magazine. U.S. Pat. No. 3,226,869 issued to Musgrave discloses such a collapsible follower. Specifically, the Musgrave follower includes two collapsible side members which are forced inwardly under a central member as the follower moves upwardly into the compression zone of the magazine and into the feed zone. Obviously, the Musgrave follower eliminates the need for a multiple follower spring. Unfortunately, the need for a collapsible follower renders the design thereof to be relatively complex.

Therefore, it is an object of this invention to provide a cartridge magazine which overcomes the aforementioned inadequacies of the prior art magazines and which provides an improvement that is a significant contribution to the advancement of the magazine art.

Another object of this invention is to provide a magazine which stores a plurality of cartridges in a three column array, and which compresses the array into a two column array in a two-position feeding arrangement.

Another object of this invention is to provide a magazine which includes a single follower having an integral, rigid design which eliminates the disadvantages of a collapsible follower.

Another object of this invention is to provide a magazine including a single follower spring.

Another object of this invention is to provide a magazine including a single integral, rigid follower and a single follower spring which are operatively connected together so as to allow the follower to pivot and move upwardly through the compression zone and in the feed zone of the magazine.

Another object of this invention is to provide a magazine including a single integral, rigid follower having a reduced width which permits the follower to, upon tilting, pass through the compression zone and into the feed zone.

Another object of this invention is to provide a magazine including a single integral rigid follower having a raised central platform which centers the follower with respect to the three column cartridge array and which exerts uniform pressure against the individual columns thereof such that a compact cartridge array can be achieved.

The foregoing has outlined some of the more pertinent objects of the invention. These objects should be construed to be merely illustrative of some of the more pertinent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention as defined by the claims taken in cojunction with the accompanying drawings.

SUMMARY OF THE INVENTION

The invention is defined by the appended claims with a specific embodiment shown in the attached drawings. For the purpose of summarizing the invention, the invention comprises a box magazine adapted for use in conjunction with a semiautomatic or an automatic firearm. The magazine comprises a storage zone for storing cartridges in a three column array, a compression zone for compressing the three column array into a two column array, and a feed zone for storing the two column array in a two-position feed arrangement enabling the ramming mechanism of the gun to sequentially ram successive cartridges into the firing chamber of the firearm. A specially designed follower having an integral design is provided for pushing the array upward within the magazine by means of a follower spring.

More particularly, the cartridges are nested together in the storage zone in three separate columns in what can be referred to as a normal, 30° array, such that a line connecting the center of a cartridge in one column to that of another cartridge in an adjacent column is inclined at a 30° angle with respect to the traverse axis of the magazine. In other words, the three columns are located vertically with respect to each other by a vertical distance equal to one-half of the diameter of the cartridges. This normal, 30° array of the cartridges is the most compact arrangement possible, and inherently eliminates any substantial side thrust against the magazine walls as the array is fed upwardly by the follower. The three column array is preferred over the more commonly found two column array, in that a larger number of cartridges may be stored within the magazine as compared to a two column magazine of the same length. Likewise, the use of three column magazine allows the same number of cartridges to be stored within a magazine of shorter length as compared to a two column magazine. A magazine having a reduced length is typically preferred when the magazine is designed to be used in a compact firearm. A three column magazine is also preferred over a four or five column magazine when it is desirable to fit the magazine within a pistol-grip of the firearm.

The follower of the invention is specially designed to push each column of the array upward within the magazine without imparting any lateral forces to the columns of cartridges of the array. Specifically, the platform of the follower includes a left, a right, and a raised central platform. The width of each of the side platforms, and the height of the central platform are each equal to substantially one-half of the diameter of the cartridges constituting the array. This particular configuration of the follower is desired such that the left, the center, and the right columns of the array are seated only on the left side platform, the central platform, and the right side platform, respectively, as the follower pushes the array upward within the storage zone. Further, it is noted that the width of the central platform is substantially equal to the shortest distance between the sides of the bottommost cartridges in the left and right columns, when the cartridges are in a normal, three column array. This assures that the platform will be automatically centered with respect to the array, thereby allowing the follower to be narrower than would otherwise be expected.

As noted earlier, the compression zone functions to compress the cartridges from the three column array in the storage zone into the two column array in the feed zone. In order to accomplish this, the inside surface of the side walls are sloped inwardly, with the slope of the left side wall being more gradual and beginning earlier than the slope on the right side wall. This causes the cartridges in the left column to be forced toward the center of the magazine before the corresponding cartridges in the right column are forced inward by the slope of the right side wall.

In order to maintain pressure against the cartridges while the follower itself is in the compression zone, the follower must be able to tilt such that an upward force is always exerted against each of the cartridges to prevent any of the cartridges from becoming unsupported at any time. A trapezoidal tab extends from the follower which is loosely positioned into the center of the follower spring. The natural flexing of the spring allows the follower to tilt with respect to the magazine. The follower may be made to tilt with respect to the spring by incorporating a pair of notches within the side edges of the tab for receiving the last turn of the follower spring.

As noted earlier, the follower maintains pressure against the bottom of the cartridge array as the cartridges are removed from the magazine. As the follower pushes the array through the compression zone into the feed zone, the edge of the right platform thereof begins to slide against the right converging surface of the right wall of the magazine. This imparts a small tilting action to the follower, but allows the follower to still maintain pressure against the bottom of the cartridge array. When the follower has moved fully into the feed zone, the follower is tilted further, with the bottommost cartridge of the two column array being in contact with only the corner of the central platform and the left side platform of the follower. This contact continues until the last cartridge has been removed from the magazine at which time the left side platform of the follower engages under the left feed lip.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to following detailed description taken in conjunction with the accompanying drawings in which.

Similar reference characters refer to similar parts throughout the several views of the drawings.

DETAILED DESCRIPTION OF THE PREFERRED EMBODIMENT

Figure 1:
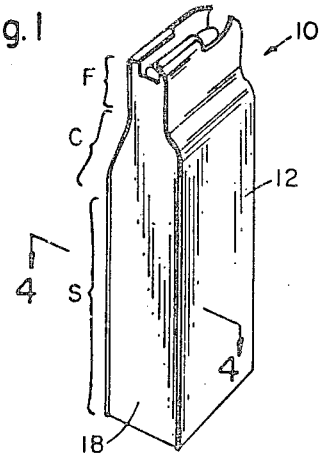
FIG. 1 is a perspective view of the box magazine of the invention.

FIG. 1 is a perspective view of the magazine 10 of the invention. Basically, the magazine 10 comprises right wall 12, left wall 14, front wall 16, rear wall 18, and a removable floor wall 20 arranged to form what is commonly referred to as a box magazine. The box magazine 10 includes a storage zone "S" for storing cartridges in three columns, a compression zone "C" for compressing the three columns into two columns, and a feed zone "F" for storing the two columns of cartridges in a two-position feed position.

Figure 2:
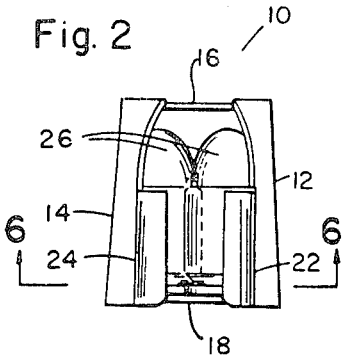
FIG. 2 is a top plan view of FIG. 1 illustrating a two position feeding arrangement of the magazine.
Figure 3:
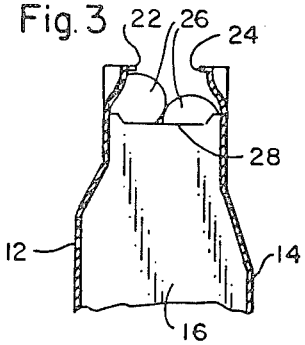
FIG. 3 is a front view of the magazine illustrating the curvature of the feed lips.

FIG. 2 is a top view of the magazine 10 illustrating the right and left feed lips 22 and 24 which are respectively integrally formed with the upper end of the feed zone F of the right and left walls 12 and 14. The feed lips 22 and 24 are curved inwardly at a radius substantially equal to that of the cartridges 26 to be loaded into the magazine 10. Preferably, the feed lips 22 and 24 curve inwardly a distance substantially equal to one-half of the diameter of the cartridge 26. Additionally, as shown in FIG. 2, the feed lips 22 and 24 preferably include a length which is slightly greater than one-half of the length of the magazine 10. The curvature and the length of the feed lips 22 and 24 and the configuration of the upper edge 28 of the front wall 16 (see FIG. 3) are selected to enable the ramming mechanism of the firearm to ram the uppermost cartridge 26 into the firing chamber of the firearm. It shall be understood, however, that other types of feed lips 22 and 24 may be incorporated into the magazine 10 of the invention without departing from the spirit and scope of this invention.

Figure 4:
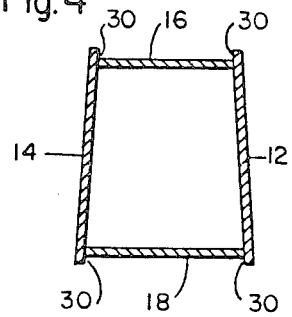
FIG. 4 is a cross-sectional view of FIG. 1 along lines 4—4 illustrating the manner in which the front and rear walls are connected between the side walls.
Figure 5:
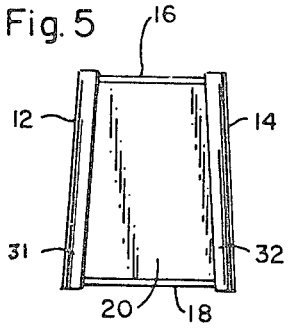
FIG. 5 is a bottom view of the magazine of the invention.

FIG. 4 is a cross-sectional view of FIG. 1 along lines 4—4 illustrating the manner in which the side walls 12 and 14 and the front and rear walls 16 and 18 are connected together. More particularly, the front and rear walls 16 and 18 are positioned an appreciable distance inward from the longitudinal edges 30 of the left and right walls 12 and 14. The walls 16 and 18 are then secured, into position by welding the walls 16 and 18 to the longitudinal edges 30, with the weld being disposed exteriorly of the magazine 10 to prevent interference with the feeding of the cartridges 26 in the magazine 10. It is noted that the magazine 10 may be manufactured in any suitable manner. For example, the walls of the magazine 10 may be made as an integral unit by a suitable molding or extrusion technique. Alternatively, the walls of the magazine 10 may be made from a single sheet of material which is suitably shaped and bent into the rectangular configuration of the magazine.

FIG. 4 also illustrates the tapered design of the magazine 10. The magazine 10 tapers inwardly from the rear wall 18 to the front wall 16 thereof. Preferably, the degree of taper is selected to accommodate the cumulative taper of conventional tapered cartridges when nested in the cartridge array. It should be understood that the walls 12 and 14 may comprise an indented configuration corresponding to other types of cartridges having bottlenecked configurations. It should also be understood that the walls 12 and 14 may include longitudinal ribs along the interior length thereof to reduce the susceptibility of the cartridges 26 to bind during feeding when foreign matter such as dirt contaminates the interior of the magazine 10.

The bottom edges 31 and 32 of the right and left walls 12 and 14 are curved inwardly at a sharp angle. The bottom edges of the front and rear walls 16 and 18 are correspondingly notched to permit the walls 16 and 18 to be positioned between the walls 12 and 14 in the position described above. The floor wall 20 comprises a flat piece of material having a configuration substantially identical to the cross-sectional configuration of the bottommost portion of the magazine 10. The floor wall 20 is removably positioned against the inwardly curved bottom edges 31 and 32 of the walls 12 and 14 by means of the follower spring 38. The floor wall 20 may be removed by pushing inwardly against the tension of the follower spring 38 and then tilting about the lateral axis of the magazine 10, such that one side edge of the floor wall 20 is able to slip past the curved bottom edge 31 or 32 of the respective wall 12 or 14. Once the floor wall 20 is removed, the follower spring 38 and the follower 40 may also be removed from the magazine 10. The follower 40, the follower spring 38, and the floor wall 20 may be reinstalled by reversing the above steps.

Figure 6:
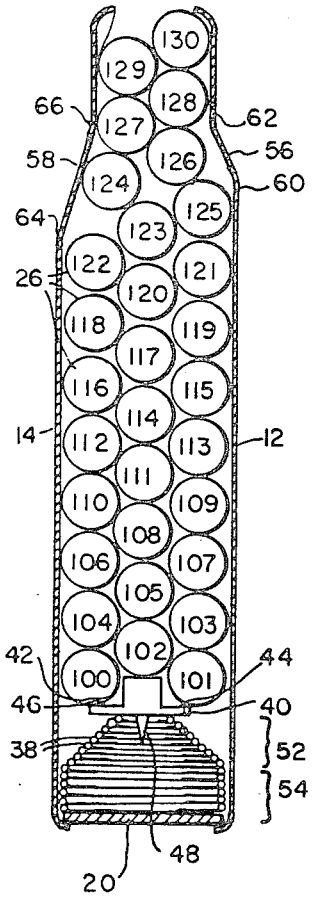
FIG. 6 is a cross-sectional view of FIG. 2 along lines 6—6 illustrating the configuration of the side walls of the storage zone, the compression zone, and the feed zone of the magazine.

FIG. 6 is a cross-sectional view of FIG. 2 along lines 6—6 illustrating the orientation of the array of cartridges 26, and the follower spring 38 and the follower 40. The cartridge array comprises three columns of cartridges 26 in the storage zone S and two columns of cartridges in the feed zone F which are nested together in what is commonly referred to as a normal, 30° array, such that a line connecting the center of a cartridge in one column to that of another cartridge in an adjacent column is inclined at a 30° angle with respect to the transverse axis of the magazine 10. In other words, the columns are located vertically with respect to each other by a vertical distance equal to one-half of the diameter of the cartridge. The normal, 30° array of the cartridges is the most compact arrangement possible, and inherently eliminates any substantial side thrust against the magazine walls 12 and 14 as the array is fed upwardly by means of the follower spring 38.

The follower 40 is specially designed to individually support the three columns of cartridges 26 constituting the array in the storage zone S, thereby enabling each column to be supported by the follower 40 and fed simultaneously with the other columns. This maintains the normal, 30° array arrangement during upward movement in the magazine 10 while eliminating side thrust of the cartridges 26 against the magazine walls 12 and 14. More particularly, the platform of the follower 40 comprises a rigidly integral design including a right and a left side platform 44 and 46 and a raised central platform 42. Preferably, the width of each of the side platforms 44 and 46 and the height of the central platform 42 are each substantially equal to one-half of the diameter of the cartridge 26 such that the right, the center, and the left columns are individually supported in the normal 30° array arrangement by the right side platform 44, the central platform 42, and the left side platform 46, respectively. The upper surface of the central platform 42 may be sloped, downwardly, toward the front thereof to at least partially compensate for the accumulated natural taper of the cartridges 26. It should be appreciated that the reduced width of the follower 40 prevents the follower 40 from binding between the walls 12 and 14 of the magazine 10 during feeding. More importantly, however, the reduced width of the follower 40 and the particular configuration thereof enables the follower 40 to push the array upwardly to sequentially feed all of the cartridges to the feed position against the respective feed lip 22 or 24.

The width of the central platform 42 is substantially equal to the shortest distance between sides of the bottommost cartridges in the left and right columns, when the cartridges are in a normal, three column array. Thus, it should be appreciated that the central platform 42 not only functions to support the center column of cartridges 26, but also functions to center the follower 40 with respect to the array. This eliminates the need for providing other means for centrally positioning the follower within the storage zone S, while permitting the width of the follower 40 to be small enough to tilt and pass through the feed zone.

Figure 7:
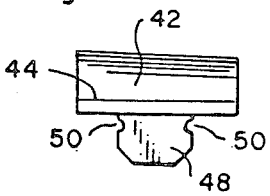
FIG. 7 is a side view of the follower.
Figure 8:
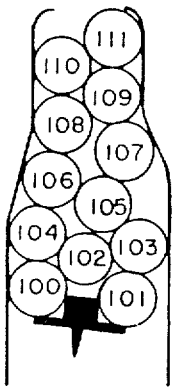
FIGS. 8–20 are schematic representations of the magazine illustrating the sequence in which the cartridges are pushed upwardly within the magazine.
Figure 9:
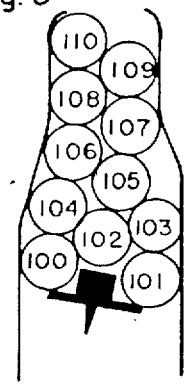
Figure 10:
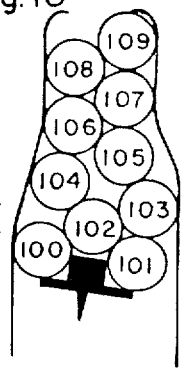
Figure 11:
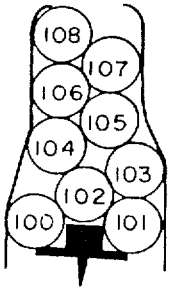

The underside of the follower 40 comprises an elongated tab 48 positioned in the center thereof. As shown in FIG. 7, a notch 50 is formed within each side end of the tab 48 for receiving the last turn of the follower spring 38. Preferably, the notches 50 are located in the side end of the tab 48 at an appreciable distance away from the underside surface of the follower 40. The notches 50 permit the follower 40 to pivot with respect to the follower spring 38. The tab 48 may alternatively comprise a trapezoidal configuration which is loosely positioned into the center of the follower spring 38. In either embodiment, it should be appreciated that the natural flexing of the follower spring 38 permits the follower 40 to pivot with respect to the magazine 10.

Returning to FIG. 6, the follower spring 38 comprises a composite design including a helical section 54 and a conical section 52, with the pitch of each turn thereof being the same for both sections. The dimensions and the length of the conical section 52 of the follower spring 38 are selected to permit the follower spring 38 to remain in contact with the bottom of the follower 40 as the latter moves upward into and pivots in the feed zone F of the magazine 10. The configuration of the helical section 54 should be selected to approximate the cross-sectional configuration of the magazine 10 in the storage zone S thereof, such that the follower spring 38 is supported by the walls of the magazine 10. That is, a cylindrical spring is suitable for a substantially square housing, whereas a rectangular spring is suitable for a substantially rectangular housing 10. The other end of the follower spring 38 is seated against the floor wall 20. The follower spring 38 functions to urge the follower 40 against the cartridge array to feed the cartridges to the ramming mechanism of the gun.

The compression zone C of the magazine 10 functions to compress the three column array into a two column array of cartridges in a reliable, geometrically predictable manner. The compression zone C is formed by forming a converging surface 56 of the right wall 12, and a similar converging surface 58 of the left wall 14. The right converging surface 56 converges inward from point 60 to point 62 at an inward distance slightly less than one-half of the diameter of the cartridges 26. Similarly, the left converging surface 58 slopes inwardly from point 64 to point 66 at an inward distance slightly less than one-half of the diameter of the cartridges 26. The converging surfaces 56 and 58 are staggered with respect to one another so as to force the left column of cartridges 26 to begin converging sooner than the opposing cartridge located in the right column. This is accomplished by positioning point 64 below point 60 a distance equal to the diameter of the cartridge 26 and by positioning point 66 approximately one-half of the diameter below point 62. The cartridges 26 are numbered to indicate the sequence and the manner in which the three column array is compressed into the two column array as the follower 40 pushes the three column array and as each individual cartridge is pushed to its feeding position against its respective feed lip 22 or 24 for ramming into the firing chamber of the firearm.

Figure 12:
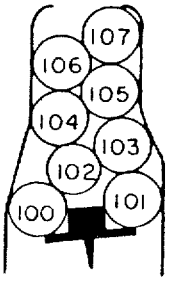
Figure 13:
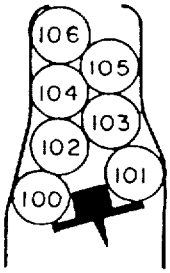
Figure 14:
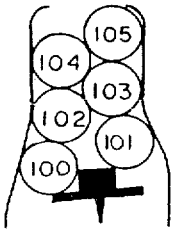
Figure 15:
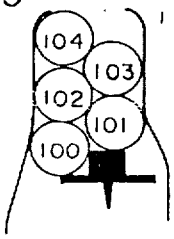
Figure 16:
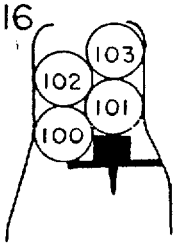

FIGS. 6 and 8–13 illustrate the order in which the three column array is compressed into the two column array by the converging portions 56 and 58 of the side walls 12 and 14 and the corresponding order in which the cartridges 26 are fed into the feed zone awaiting ramming into the firing chamber of the gun. Each of the cartridges 26 are numbered to show the sequence in which the three column array is compressed into the two column array, and the order in which the cartridges 26 are removed upon being rammed. Specifically, referring to FIGS. 8 and 9, it can be seen that the staggered, converging surfaces 56 and 58 cause the cartridges in the left and right outer columns to be compressed inwardly while the cartridges in the center column are merged alternately with the cartridges of the left and right columns as the array moves upwardly toward the feed lips. Referring to FIG. 12, it is seen that when the last cartridge in the center column is forced to its respective side column, there exist only two columns of cartridges which constitute the array.

Figure 17:
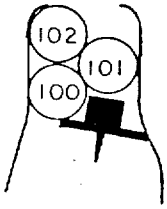
Figure 18:
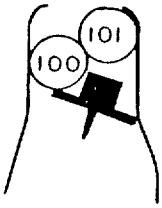
Figure 19:
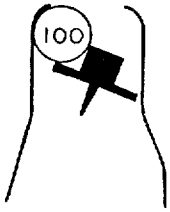
Figure 20:
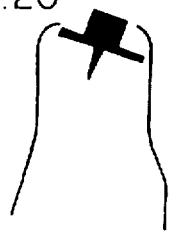

As shown in FIGS. 12–20, the follower 40 continues to function to push the array upward for feeding to the feed lips 22 and 24. As noted earlier, the follower 40 is able to pivot with respect to the end of the follower spring 38. This pivoting action is required in order that the follower 40 may remain in contact with the cartridges so as to keep the cartridges in a tight, predictable order. When only three cartridges remain in the magazine 10, as shown in FIG. 17, the outer edge of the right side platform 44 of the follower 40 becomes in contact with the right converging surface 56. At this point, as another cartridge is removed from the magazine 10, it is seen that the corner of the side platform 44 slides upward along the right converging surface 56, thereby maintaining pressure against the two remaining cartridges (see FIG. 18). When another cartridge is removed, the follower 40 begins to pivot at approximately point 66 such that the last cartridge remaining is forced upward against the left feed lip 24 by contact with the left side platform 46 and the center platform 42 of the follower lip 40. Finally, when the last cartridge is removed, the follower 40 pivots further until the left side platform 46 is engaged under the left feed lip 24 and the right side platform 44 is engaged under the right feed lip 22, with the central platform 42 protruding from the upper surface of the magazine 10. It is noted that the central platform may be designed to catch and hold the ramming mechanism of the firearm directly after the firing of the last round to indicate to the gunner that there are no more cartridges in the magazine.

It should be appreciated that the unique design of the follower 40 overcomes many of the inherent disadvantages of the prior art multiple column magazines in that only a single follower 40 of rigid, integral design, and a single follower spring 38 is necessary to push the cartridge array, upwardly, while precisely maintaining the order in which the cartridges are fed to the ramming mechanism of the firearm.

I claim:

1. A magazine, comprising in combination:

a housing including left and right side walls;

said left and right side walls being configured to define a storage zone for storing a plurality of cartridges in a three column array, a compression zone for compressing the three column array into a two column array, and a feed zone for storing the two column array in a two-position feeding arrangement;

a follower positioned beneath the plurality of cartridges;

means for urging said follower against the plurality of cartridges; and said follower including left and right side platforms and a raised central platform for engagement with the left, right and central columns of cartridges, respectively, of the three column array enabling said follower to exert pressure upwardly against the cartridges and to be centrally located by means of the three column array.

2. The magazine as set forth in claim 1, wherein the width of said follower is substantially equal to the diameter of one of the cartridges plus the shortest distance between the bottommost cartridges in the left and right columns of the three column array when the array is in a normal, 30° arrangment.

3. The magazine as set forth in claim 1, wherein said urging means comprises a compression spring means positioned between said follower and the bottom of the storage zone of the magazine.

4. The magazine as set forth in claim 3, wherein said compression spring means engages said follower whereby the natural flexibility of said compression spring means enables said follower to pivot with respect to the magazine to permit said follower to tilt and enter the compression zone and the feed zone while maintaining pressure upwardly against the cartridges.

5. The magazine as set forth in claim 4, wherein said follower includes means for pivoting with respect to said compression spring means.

6. The magazine as set forth in claim 5, wherein said pivot means includes a pair of notches formed within a tab extending from said follower for connection to said compression spring means.

7. The magazine as set forth in claim 3, wherein the bottom of the storage zone comprises a bottom plate which is removably secured into position by resting on inwardly curved edges of the bottom of said side walls.

8. A magazine, comprising in combination:

a housing including left and right side walls;

said left and right side walls being configured to define a storage zone for storing a plurality of cartridges in a three column array, a compression zone for compressing the three column array into a two column array, and a feed zone for storing the two column array in a two-position feeding arrangement;

a follower positioned beneath the plurality of cartridges;

means for urging said follower against the plurality of cartridges; and said follower including left and right side platforms and a raised central platform for engagement with the left, right and central columns of cartridges, respectively, of the three column array enabling said follower to exert pressure upwardly against the cartridges, the width of each said side platform being substantially equal to one-half the diameter of the cartridges and the width of said central platform being substantially equal to the shortest distance between the bottommost cartridges in the left and right columns of the three column array when the array is in a normal, 30° arrangement such that said follower is centrally located by means of the three column array.

9. The magazine as set forth in claim 8, wherein said urging means comprises a compression spring means positioned between said follower and the bottom of the storage zone of the magazine.

10. The magazine as set forth in claim 9, wherein said compression spring means engages said follower whereby the natural flexibility of said compression spring means enables said follower to pivot with respect to the magazine to permit said follower to tilt and enter the compression zone and the feed zone while maintaining pressure upwardly against the cartridges.

11. The magazine as set forth in claim 10, wherein said follower includes means for pivoting with respect to said compression spring means.

12. The magazine as set forth in claim 11, wherein said pivot means includes a pair of notches formed within a tab extending from said follower for connection to said compression spring means.

13. The magazine as set forth in claim 9, wherein the bottom of the storage zone comprises a bottom plate which is removably secured into position by resting on inwardly curved edges of the bottom of said side walls.

14. A magazine, comprising in combination:

a housing including left and right side walls;

said left and right side walls being configured to define a storage zone for storing a plurality of cartridges in a three column array, a compression zone for compressing the three column array into a two column array, and a feed zone for storing the two column array in a two-position feeding arrangement;

an integral, non-distortable follower positioned beneath the plurality of cartridges;

means for urging said follower against the plurality of cartridges; and said follower including left and right side platforms and a raised central platform for engagement with the left, right and central columns of cartridges, respectively, of the three column array enabling said follower to exert pressure upwardly against the cartridges and to be centrally located by means of the three column array.

* * * * *

UNITED STATES PATENT AND TRADEMARK OFFICE

CERTIFICATE OF CORRECTION

PATENT NO. : 4,428,137

DATED : January 31, 1984

INVENTOR(S) : JAMES H. JOHNSON

It is certified that error appears in the above-identified patent and that said Letters Patent is hereby corrected as shown below:

Column 1, line 35, delete the word "in", insert --with--;

Column 1, line 38, delete the word "magazne", insert --magazine--;

Column 1, line 58, delete the word "merged", insert --merge--;

Column 1, line 59, delete the word "approached", insert --approach--;

Column 3, line 20, insert the word --a-- following the word "of";

At column 7, line 47, delete the word "gun", insert --firearm--; and

At column 8, line 12, delete the word "are", insert --is--.

UNITED STATES PATENT AND TRADEMARK OFFICE

CERTIFICATE OF CORRECTION

PATENT NO. : 4,428,137

DATED : January 31, 1984

INVENTOR(S) : James H. Johnson

It is certified that error appears in the above-identified patent and that said Letters Patent is hereby corrected as shown below:

In the drawings, Sheet 2, Figs. 8-20 were omitted from the printed patent and should be inserted therein.

Signed and Sealed this

*Thirtieth* Day of *July 1985*

[SEAL]

*Attest:*

DONALD J. QUIGG

*Attesting Officer* *Acting Commissioner of Patents and Trademarks*